US006219841B1

(12) United States Patent
Anderson

(10) Patent No.: US 6,219,841 B1
(45) Date of Patent: Apr. 24, 2001

(54) IMMERSION SUIT ENTRY SYSTEM

(75) Inventor: Mark Richard Anderson, Delta (CA)

(73) Assignee: Mustang Survival Corp, Richmond (CA)

( * ) Notice: Subject to any disclaimer, the term of this patent is extended or adjusted under 35 U.S.C. 154(b) by 0 days.

(21) Appl. No.: 09/526,520

(22) Filed: Mar. 16, 2000

(51) Int. Cl.[7] ..... B63C 11/04; B63C 11/10
(52) U.S. Cl. ..... 2/2.17
(58) Field of Search ..... 2/2.17, 69, 79, 2/96, 309, 311, 265, 913

(56) References Cited

U.S. PATENT DOCUMENTS 2,582,811 * 1/1952 Williams .
3,058,187 * 10/1962 Gugen .
3,643,264 * 2/1972 Rector ..... 2/2.17
3,731,319 * 5/1973 O'Neill ..... 2/2.17
4,464,795 * 8/1984 Long et al. ..... 2/2.17
4,862,517 * 9/1989 Meistrell ..... 2/2.17
5,191,658 * 3/1993 Meistrell ..... 2/2.17
5,940,879 * 8/1999 Whitehouse ..... 2/2.17

* cited by examiner

*Primary Examiner*—John J. Calvert
*Assistant Examiner*—Robert H. Muromoto, Jr.
(74) *Attorney, Agent, or Firm*—C. A. Rowley

(57) ABSTRACT

An easy access immersion suit, in which the zippered opening starts at the crotch, runs diagonally up across and around the hip, diagonally across the back and ending at the underarm opposite the previous referred to hip.

8 Claims, 4 Drawing Sheets

IMMERSION SUIT ENTRY SYSTEM

FIELD OF THE INVENTION

The present invention relates to an immersion with a diagonal opening configured to permit easy donning and doffing of the suit by the user.

BACKGROUND OF THE INVENTION

Immersion suits are used for example by personnel in search and rescue and other high-risk occupations involving the chance of cold water immersion. The challenge is to create a full body suit that will keep the user dry when immersed in water but at the same time not restrict the user when performing daily activities. With traditional immersion suits for this role the user requires assistance to correctly do up the zippers while donning the suit. An immersion suit that allows the user to don/doff it themselves would be a significant improvement.

Traditional immersion suits usually have two water tight zippers, a donning/doffing zipper plus a defecate/urination zipper for males. With more and more female users, the need for a multi-sex immersion suit entry system is apparent.

U.S. Pat. No. 4,464,795 issued Aug. 14, 1984 to Long et al discloses an easy access underwater diving suit wherein the torso portion of the suit and provides access by a zipper extending diagonally across the front from one shoulder to the opposite hip. The extra long torso portion is extended to permit the wearer to don the suit and is then adjusted to the size of the user and fastened in this position. This construction permits the user to don and doff the suit unaided, however it requires significantly extra material and is bulky when worn.

U.S. Pat. No. 4,862,517 issued Sep. 5, 1989 to Meistrell describes a wet suit with and offset zipper that extends at across the rear of the suit at an angle across the back bone of the user so that the zipper used to close the split does not interfere with bending movements of the user. While this system does use and diagonally extending zipper it is ineffective in solving the problems solved by the present invention.

SUMMARY OF THE INVENTION

It is the primary object of the present invention to provide an immersion suit that can be quickly and easily put on and taken off by the user without assistance.

It is another object of the present invention to provide a new and improved entry system to an immersion suit that allows both male and female users to relieve themselves.

It is a further object of the present invention to provide an immersion suit that can be easily manufactured and reduces the number of seams to be sealed.

It is a further object of the present invention to provide an immersion suit in which the closure zipper does not unduly or significantly restrict the movement of the user.

Broadly the present invention relates to an immersion suit with a water tight entry system that starts at the crotch, runs diagonally up across and around the hip, diagonally across the back and ending at the underarm opposite the previous hip.

Broadly the invention relates to an immersion suit comprising an upper torso portion integral with a lower torso portion, a closeable opening line extending around said suit in spiral fashion between a crotch portion of said lower torso portion and on one side of said suit upward across a front of said suit around to a back of said suit and upward and across said back of said suit to terminate adjacent to an arm receiving portion of said upper torso portion, also on said one side of said suit.

Preferably said suit includes a waterproof zipper for opening and closing said closeable opening line.

Preferably said upper torso portion is provided with a neck receiving opening with a neck seal therearound.

Preferably said lower torso portion has a pair of waterproof leg receiving portions each or which includes a waterproof foot receiving portion and wherein said upper torso portion includes arm receiving protions

BRIEF DESCRIPTION OF THE DRAWINGS

Further features, objects and advantages will be evident form the following detailed description of the preferred embodiment of the present invention taken in conjunction with the accompanying drawings in which.

DESCRIPTION OF THE PREFERRED EMBODIMENTS

Figure 1:
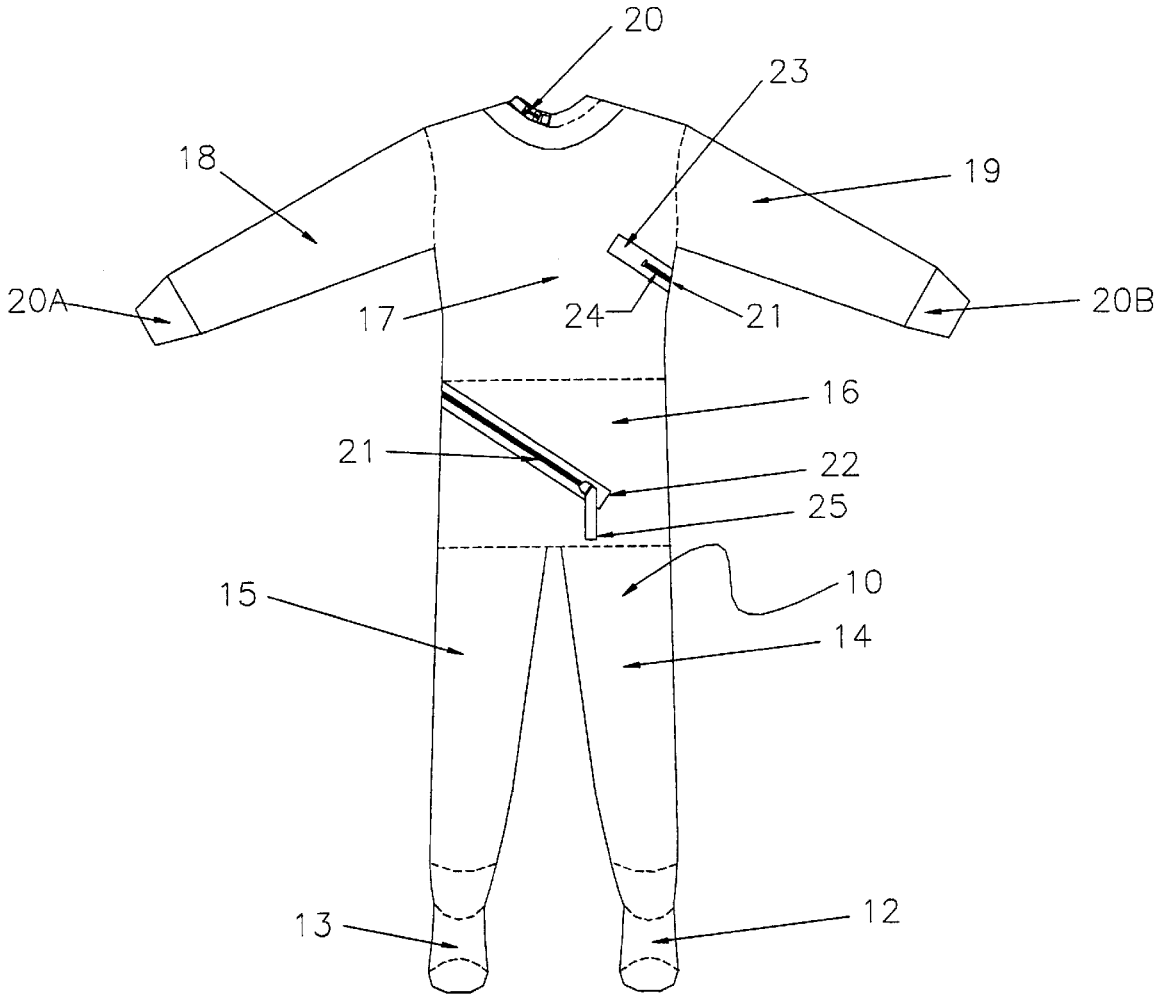
FIG. 1 is a front elevation showing the frontal section of an immersion suit incorporating the invention.
Figure 2:
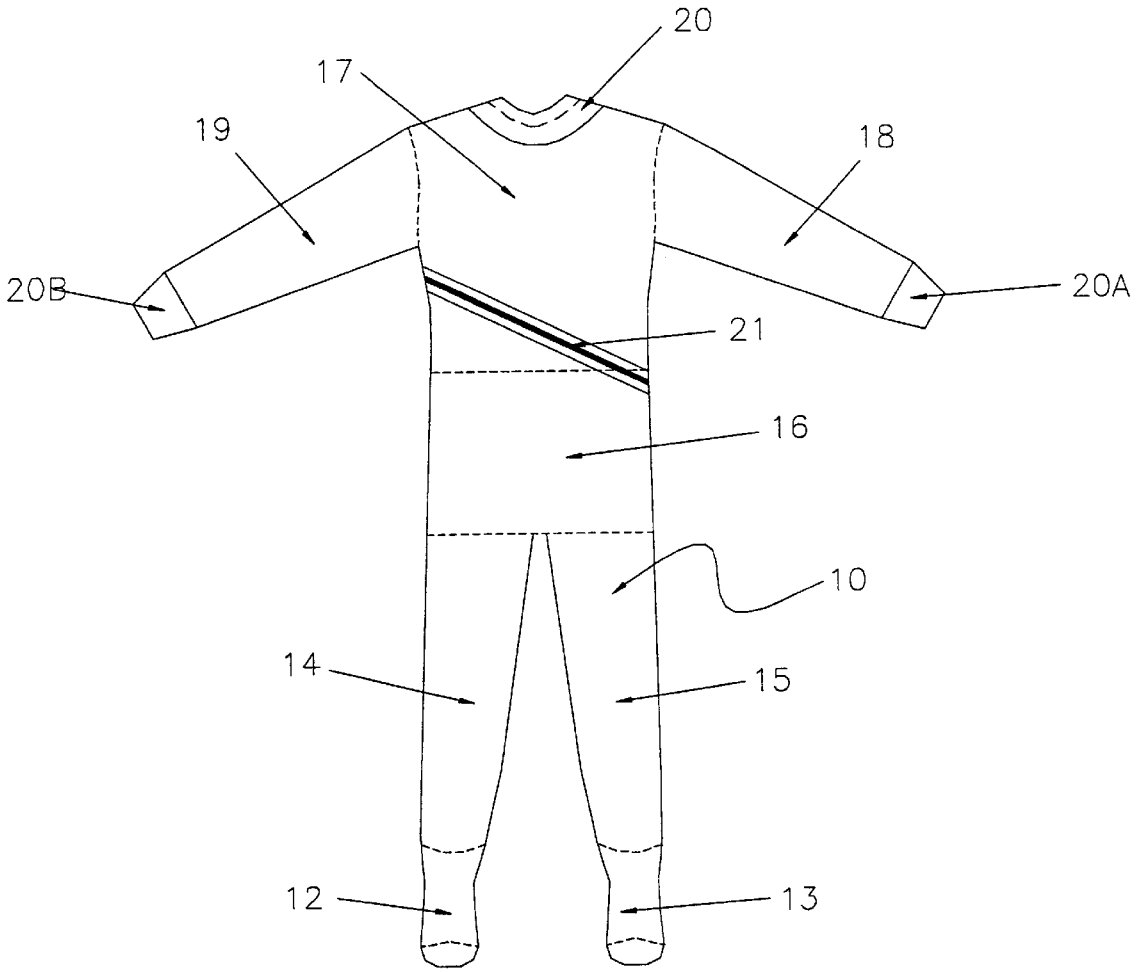
FIG. 2 is a rear elevation showing the rear section of an immersion suit incorporating the invention.

FIG. 1 and FIG. 2 show front and rear views, respectively, of a typical full body immersion suit 10. The suit 10 is comprised of a lower torso section or portion 16 with integral leg portions 14 and 15 each having a foot receiving socks portions 12 and 13 attached thereto. An upper torso portion or section 17 is attached to the lower torso section 16. The upper torso portion 17 has attached thereto left and right arm portions 18 and 19 attached thereto each having a wrist receiving seal indicated at 20A and 20B respectively and is provided with a neck receiving seal 20 though which the neck of the user extends when the suit is worn.

The immersion suit 10 is typically made of a liquid waterproof, water vapour permeable membrane material e.g. a waterproof water vapor permeable laminate textile. The neck seal 20 and wrist seals 20A and 20B are made of a stretchable membrane material.

The entry system opening or separation line 21 starts at lower end 22 on the frontal section in the crotch region and offset horizontally from the center of the suit or garment and preferably above where the leg portions 14 and 15 join the lower torso 16 section. The opening 21 traverses along a line that diagonally crosses the front of the suit 10 to, in the illustrated embodiment, where the upper torso section 17 joins the lower torso section 16 and the front of the suit joins the back of the suit (see FIG. 1). The opening line 21 continues along a straight line diagonally across the rear section of the upper torso portion 17 (see FIG. 2) and wraps around to the frontal section (see FIG. 1) to terminate at an upper end 23 adjacent to where the arm portion 19 joins the upper torso portion 17.

The upper end 23 and the lower end 22 of the opening 21 are both positioned on the same side of the garment or suit 10 and in the illustrated arrangement are substantially vertically aligned. A waterproof zipper illustrated at 24 is used to open and close the opening 21.

Figure 3:
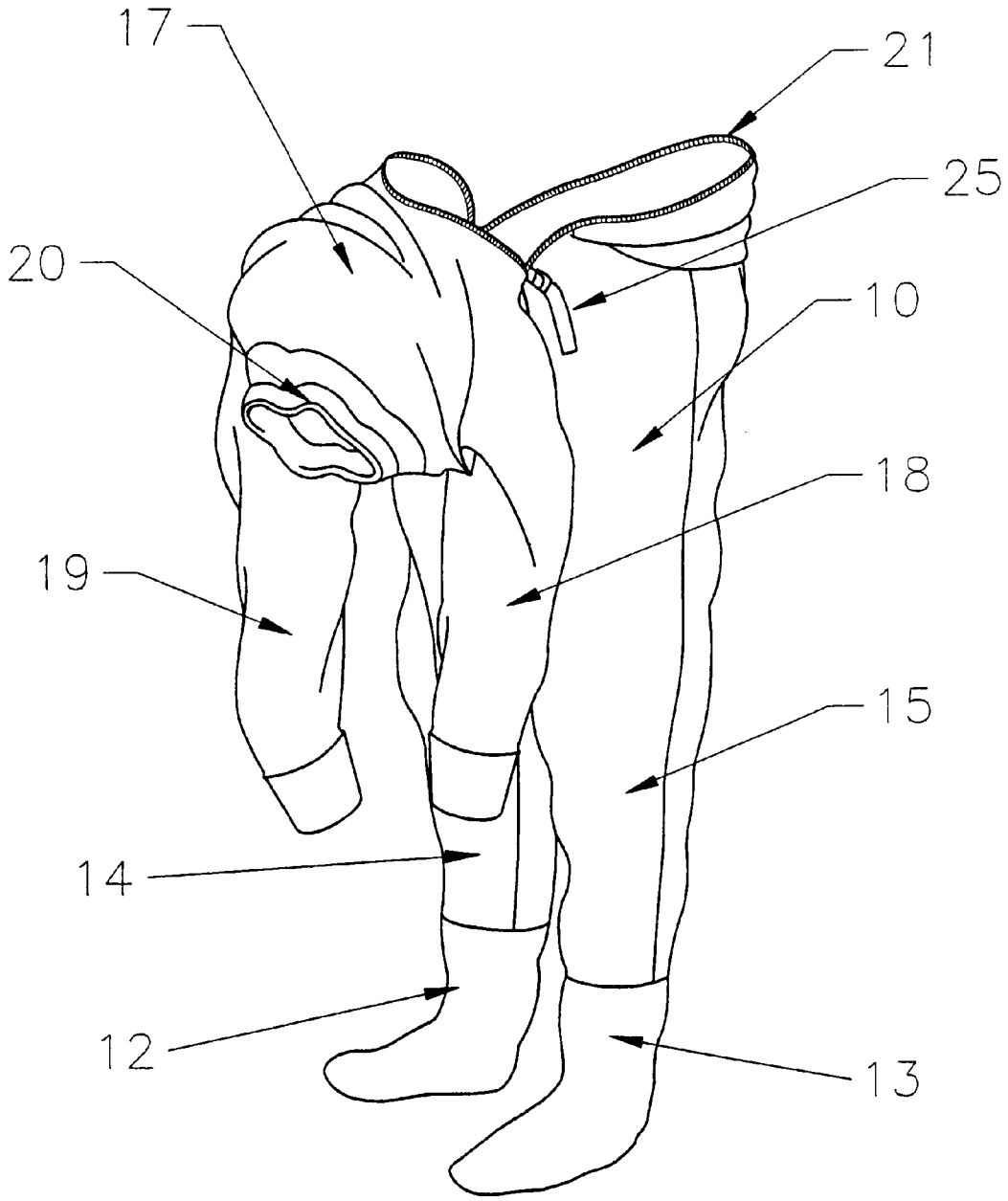
FIG. 3 is an isometric side view of an immersion suit with the zipper opening apart ready for donning.

In reference to FIG. 3., with the opening 21 undone the upper torso portion 17 can be folded downward toward the front along a substantially horizontal fold line at about the level where the leg portions 14 and 15 attach to the lower torso 16 section. This folding of the suit allows for the user to enter lower portion 16 by pushing his or her legs and feet into the leg portions 14 and 15 and sock portions 12 and 13 and then pull the upper torso portion 17 on with the neck of the user being received through the neck seal 20 and the arms in the arm sections 18 and 19 and with the wrist seals 20A and 20B in sealing relationship with the wrists of the user.

In putting the suit on, the user separates the two sections created by the watertight zipper and bends the upper half over and away from the lower half. The user then inserts his or her legs into the leg portions and then their arms into the arm portions and then their head through the neck portion. Once donned, the user starts to do up the water tight zipper by first grabbing the upper end 23 of the zipper 24 with his or her right hand and at the same time grabbing the zipper pull 25 with the left hand. When the zipper is done up to about one third of the way across the back the user then grabs the upper end 23 of the zipper 24 with the left hand, and at the same time reaches around their back with the right hand and grabs the zipper pull 25. The user then pulls the remaining part of the zipper closed in this position by pulling the pull 25.

Figure 4:
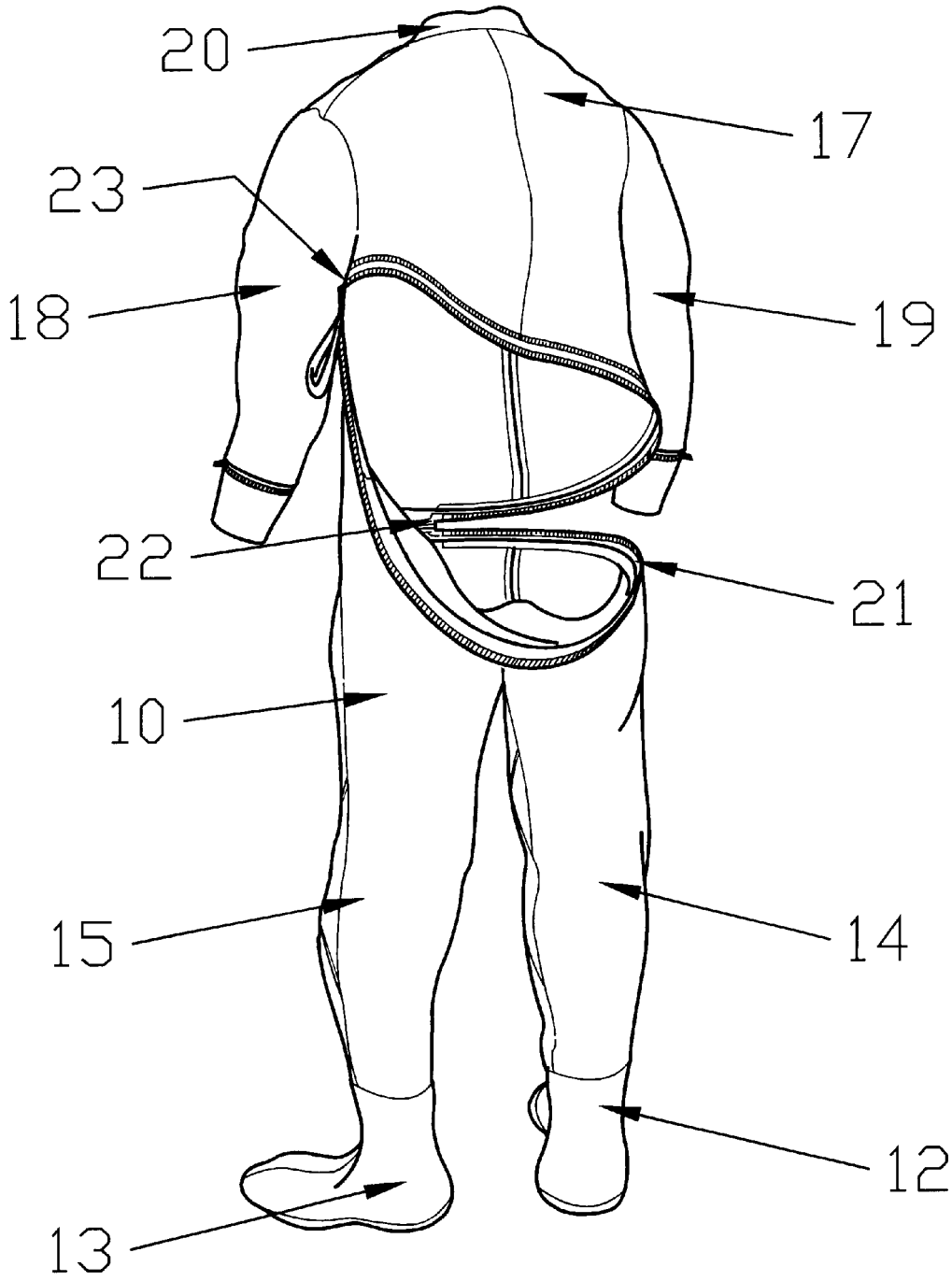
FIG. 4 is an isometric rear view on an immersion suit constructed in accordance with the present invention showing the size of the opening at the rear that permits the wearer to urinate and/or defecate without removal of the suit.

As shown in FIG. 4 when the zipper 24 is undone (essentially the reverse of doing up the zipper) the rear of the suit is completely open from below the hips to above the waist of the wearer so that by bending into a sitting or semi sitting position the posterior of the user protrudes from the suit to permit the wearer, male or female to defecate and/or urinate without doffing or removal the suite and without the suit interfering.

Having described the invention modifications will be evident to those skilled in the art without departing from the spirit of the invention as defined in the appended claims.

I claim:

1. An immersion suit with a water tight entry system that starts at one side of said suit in a lower torso portion, runs diagonally up across and around a front of said suit and then diagonally across a back of said suit and terminating on said front of said suit in an upper torso portion on said side of said suit.

2. An immersion suit comprising an upper torso portion integral with a lower torso portion, a closeable opening line extending around said suit in spiral fashion between a crotch portion of said lower torso portion and on one side of said suit upward across a front of said suit around to a back of said suit and upward and across said back of said suit to terminate adjacent to an arm receiving portion of said upper torso portion, also on said one side of said suit.

3. An immersion suit as defined in claim 2 wherein said suit includes a waterproof zipper for opening and closing said closeable opening line.

4. An immersion suit as defined in claim 2 wherein said upper torso portion is provided with a neck receiving opening with a neck seal therearound.

5. An immersion suit as defined in claim 3 wherein said upper torso portion is provided with a neck receiving opening with a neck seal therearound.

6. An immersion suit as defined in claim 2 wherein said lower torso portion has a pair of waterproof leg receiving portions each or which includes a waterproof foot receiving portion and wherein said upper torso portion includes arm receiving portions each provided with a wrist seal.

7. An immersion suit as defined in claim 3 wherein said lower torso portion has a pair of waterproof leg receiving portions each or which includes a waterproof foot receiving portion and wherein said upper torso portion includes arm receiving portions each provided with a wrist seal.

8. An immersion suit as defined in claim 4 wherein said lower torso portion has a pair of waterproof leg receiving portions each or which includes a waterproof foot receiving portion and wherein said upper torso portion includes arm receiving portions each provided with a wrist seal.

* * * * *